United States Patent [19]

Kutzner et al.

[11] 4,264,033

[45] Apr. 28, 1981

[54] SHUT-OFF PLATE FOR COMBUSTION SPACES ADJUSTABLE BY MOTOR

[75] Inventors: Luitpold Kutzner, Marschner Strasse 78, D- 8000 Munich 60; Erwin Postenrieder, Mering, both of Fed. Rep. of Germany

[73] Assignee: Luitpold Kutzner, Munich, Fed. Rep. of Germany

[21] Appl. No.: 900,812

[22] Filed: Apr. 27, 1978

[30] Foreign Application Priority Data

May 4, 1977 [DE] Fed. Rep. of Germany ..... 2720009

[51] Int. Cl.[3] ..... G05D 23/00; H02K 23/68; B60T 1/16

[52] U.S. Cl. ..... 236/1 G; 431/20; 318/485; 318/372; 188/270

[58] Field of Search ..... 236/1 G, 10; 431/20; 318/485, 372, 614; 192/84 A, 82 T; 188/270, 163, 72.1

[56] References Cited

U.S. PATENT DOCUMENTS

| | | | |
|---|---|---|---|
| 184,979 | 12/1876 | Neville | 188/270 X |
| 2,856,992 | 10/1958 | Bartels | 236/10 X |
| 3,090,558 | 5/1963 | Vaughn | 236/1 G |

*Primary Examiner*—Henry C. Yuen

*Assistant Examiner*—Harry Tanner

*Attorney, Agent, or Firm*—Toren, McGeady and Stanger

[57] ABSTRACT

A shut-off device for installation in the waste gas line from combustion spaces. The device includes a flow-through housing, a shut-off plate mounted in this flow-through housing and adjustable, and a positioning motor arranged on the outside of the flow-through housing for the shut-off plate. The shut-off plate is biased by a spring in a direction toward a first terminal position defined by an abutment and is capable of being adjusted by the positioning motor in a direction toward a second terminal position defined by a second abutment. At least one limit switch is provided for actuation by a control element in the open position of the shut-off plate and serving to initiate operation of combustion spaces arranged upstream from the shut-off device. The positioning motor is a rapidly rotating electric motor having a motor shaft connected with the transmission input of a step down transmission for converting the rotary speed of the motor into a slower speed. The transmission output is connected with the shut-off plate. The spring engages the shut-off plate and/or a transmission part near the transmission output. A checking device is provided for engagement with the motor shaft and/or a transmission part near the transmission output.

19 Claims, 10 Drawing Figures

SHUT-OFF PLATE FOR COMBUSTION SPACES ADJUSTABLE BY MOTOR

The invention starts from a shut-off device for installation in the waste gas line from combustion spaces including a flow-through housing, a shut-off plate arranged in this flow-through housing and movable, preferable pivotable between an open position and a shut-off position, and a positioning motor for the shut-off plate arranged on the outside of the flow-through housing, the shut-off plate being biased by a spring in a direction toward a first terminal position defined by an abutment, and being movable by means of the positioning motor in a direction toward a second terminal position defined by a second abutment, at least one limit switch actuated by a control element in the open position of the shut-off plate being provided for starting of combustion spaces located upstream from the shut-off device, the positioning motor being constituted by a rapidly rotating electric motor whose motor shaft is connected to the transmission input of a step-down transmission which converts the rotary speed of the motor to lower speed, and whose transmission output is connected with the shut-off plate, the spring being coupled to the transmission output or to a transmission element near the transmission output.

Essential elements of such a device are described and illustrated in the published German patent applications Nos. P 23 48 012 and P 24 38 875.

As compared to shut-off devices in which the shut-off plate is moved in both directions by a positioning motor, shut-off devices of the afore-described type have the advantage that they can be made as to structure and cost of controls. However, it is not possible in the known shut-off devices of the initially described type of influence the rate of movement of the shut-off plate during return movement by the spring.

It is the object of the invention to modify a shut-off device of the initially described type with minimal additional expense for structure and circuitry in such a manner that the positioning movement of the shut-off plate may be influenced.

It is proposed according to the invention to solve this task by providing a checking device for engagement with the motor shaft and/or a transmission part near the transmission input.

Because of the high transmission ratio between transmission input and transmission output, a small, relatively weak electric motor having an energy consumption of a few watts suffices for adjusting the shut-off plate even against the restoring force of a relatively strong spring. Because of the engagement of the checking device with the motor shaft and/or a transmission element near the transmission input, it is possible, therefore, to brake the motor shaft and thereby also the shut-off plate by means of the step-down transmission with a minimal input of force or to hold these elements in a desired position.

The positioning velocity of the shut-off plate when moved by the positioning motor is defined by the rotary motor speed and the transmission ratio of the step-down transmission and may be set by corresponding choice of these two parameters at a suitable value at which the requirements of the combustion space are satisfied, and the shut-off device cannot be damaged by excessively hard butting of one of the moving parts against the abutment defining the terminal position. The spring for returning the shut-off plate after switching off of the positioning motor tends to relax suddenly while the return movement is damped only by the transmission and occurs very rapidly. This, for one, has the disadvantage that the shut-off device is damaged in the long run by overly hard butting of the shut-off plate or of an element connected therewith against the abutment defining the terminal position. Furthermore, it may be desirable for operation of the combustion space that the transition from the one position of the shut-off plate to the other position of the shut-off plate occur not so rapidly. It is not advisable to solve this problem by making the spring correspondingly weaker because the tension of the spring must be so great, for reasons of safety, that it can turn the shut-off plate back even under unfavorable conditions after switching off of the motor.

According to the invention, the problem described above is solved in a very simple manner that the checking device includes a brake whose brake moment increases with increasing rotary speed. The brake thus may be designed in such a manner that the braking moment is only very small at the rotary speed characteristic of the positioning motor whereas it assumes a considerable value at the higher speed of the motor shaft caused by the returning force of the spring. It is possible thereby to avoid the brake from being switched on and off and the associated switching cost. The brake may remain connected permanently with the motor shaft and/or a transmission part near the transmission output, while still only the return movement of the shut-off plate due to the spring is significantly braked.

The afore-described characteristics of the brake may be achieved, for example, by a brake including an air resistance element connected to the motor shaft for joint rotation. A particularly simple embodiment of such an air resistance element consists, for example, of a substantially cylindrical rotor coaxially mounted on the motor shaft and rotatable in a substantially cylindrical, coaxial recess of a stator to define an air gap between the circumferential rotor surface and the circumferential surface of the recess. This rotor may thus be constituted by a flat disc that may be prepared in a very simple way, and the formation of turbulence in the air gap may suffice to brake the return movement of the shut-off plate due to the spring in the desired manner.

The air resistance element, of course, may also assume another shape, for example, that of a vane wheel. In this case, the brake moment is readily made dependent on the direction of rotation.

The existing structure of the shut-off device practically needs scarcely to be changed if the rotor and stator are arranged on the side of the motor directed away from the transmission. It is sufficient to extend the motor shaft a little and to fasten the stator on the motor.

During shut-down of a combustion space, particularly after an extended period of operation, delayed combustion may still occur in the combustion space despite the switching off of the combustion space. The waste gases generated thereby still must be capable of leaving the combustion space. It is thus desirable that the waste gas conduit not be closed immediately with the switching off of the combustion space.

This problem is solved by the checking device according to the invention by controlling the same in such a manner that it does not interfere with the opening of the shut-off plate when the combustion space is started up, but delays the closing of the shut-off plate after switching off of the combustion space. By means of the design and control of the checking device according to the invention, the desired delay can be achieved in an extremely simple manner involving only little expense. It would certainly be possible to find an electronic delay circuit which permits actuation of the shut-off device with the desired delay after the termination of operation of the combustion space. However, such a circuit would be more complicated in all instances than the solution of the invention, and particularly would require a disproportionately greater expense. A desired delay of the beginning of the return movement is achieved in a simple manner if the checking device includes an electrically heated bimetallic element. With such a bimetallic element, both its response lag during switching on of the electric heater as well as its response lag during switching off of the electric heater may be employed for the delay. The desired control of the checking device is achieved in a simple manner, for example, by making the electric heating of the bimetal element dependent on the state of operation of the motor.

According to a first embodiment, provisions are made for switching the electric heater during closing of the shut-off plate by the spring and during opening and holding open of the shut-off plate by the positioning motor after switching on of the motor current, that the checking device becomes effective by switching the heater on, but, because of the response lag of the bimetal element only after opening of the shut-off plate, and by shutting off the heater by switching the motor current off, the checking device being inactivated by the switching off of the heater, but, because of the response lag of the bimetal element, only with a delay. This delay can be varied within wide limits by selection of the bimetal element and the strength of its heater.

Whereas the shut-off plate in the afore-described exemplary embodiment is opened by the positioning motor and closed again by the spring, the shut-off device may also be designed or installed in such a manner that the opening and holding-open of the shut-off plate is achieved by means of the spring, and closing of the shut-off plate by means of the positioning motor. In this case, the checking device may be controlled in such a manner that the electric heater is switched on by switching on of the motor current, that the checking device becomes ineffective by switching on of the heater, but only with a delay due to the response lag of the bimetal element, and that the heater is switched off, and the checking device becomes effective by switching the motor current off, but only after opening of the shut-off plate due to the response lag.

In both embodiments described so far, the heater of the bimetal element may be arranged in series with the motor.

For both modes of operation of the shut-off device described above, the checking device may also be controlled in such a manner that the electric heater is switched on during switching on of the combustion space, that the checking device becomes effective by the switching on of the heater, and the electric heater is switched off during switching off of the combustion space, and the checking device becomes ineffective by the switching off of the heater, but, because of the response lag of the bimetal element, only with a delay.

In this case, a series arrangement of the heater of the bimetal element with the positioning motor is not possible, but the heater of the bimetal element may be arranged in the conductor leading from the limit switch to the combustion space. According to a very simple embodiment, the bimetal element itself constitutes a checking member by engaging the afore-described rotor, for example, when the checking device becomes effective, and/or by engaging a transmission part near the transmission input. Because of the small force required for stopping the motor, relatively light pressure exerted by the bimetal element on the rotor is sufficient for stopping the latter.

In the hitherto known shut-off devices of the initially defined type, the shut-off plate can assume only two defined positions in which it opens and closes the waste gas line respectively. This form of the shut-off device is disadvantageous for combustion spaces capable of being operated at two output levels. Because the waste gas line needs to be designed in all cases for withdrawing the waste gases generated at full capacity, full opening of the waste gas line during operation of the combustion space at low or intermediate output would mean that the waste gases are exhausted too fast and thereby cause a substantial loss of heat so that the combustion space cannot be operated optimally.

This difficulty is resolved by the shut-off device of the invention according to an essential feature of the present invention by a checking device controlled for operation of a combustion space at at least two different output levels in such a manner that it becomes effective in an intermediate position of the shut-off plate adapted to the condition of partial output operation and becomes ineffective at a change in the operating condition of the combustion space. Such control may occur without substantial change in the design of the shut-off device, for example, by the provision of an additional limit switch actuated in the intermediate position of the shut-off by the control element, the limit switch serving for starting operation of the combustion space in the partial capacity range, the checking device becoming effective by the operation of the switch, and by the checking being capable of being released independently from a change in the switching condition of the additional limit switch. When the combustion space at first is to be operated only in the partial capacity output range, the shut-off plate is opened, and the control element following the movement of the shut-off plate actuates the additional limit switch in the intermediate position of the shut-off plate, and the latter initiates operation of the combustion space. Simultaneously, the checking device becomes operative and prevents complete opening of the shut-off plate. In order to operate the combustion space at full capacity, it is sufficient to inactivate the checking device whereupon the shut-off plate is opened completely, the control element actuates the first limit switch which then initiates operation of the combustion space at full capacity.

According to an embodiment capable of simple construction, the checking device includes a checking member operated electrically, for example, by means of an electromagnet, the electromagnet being arranged in series circuit with the additional limit switch through an interruptor switch, opening of the interruptor switch inactivating the checking device.

The checking member may also be arranged in such a manner as to engage the motor. It is found particularly in this embodiment that the essential operating improvements can be achieved in the shut-off device of the invention by very simple means.

Further features and advantages of the invention are evident from the dependent claims and the following description explaining the invention in connection with the appended drawings of exemplary embodiments in which:

Figure 1:
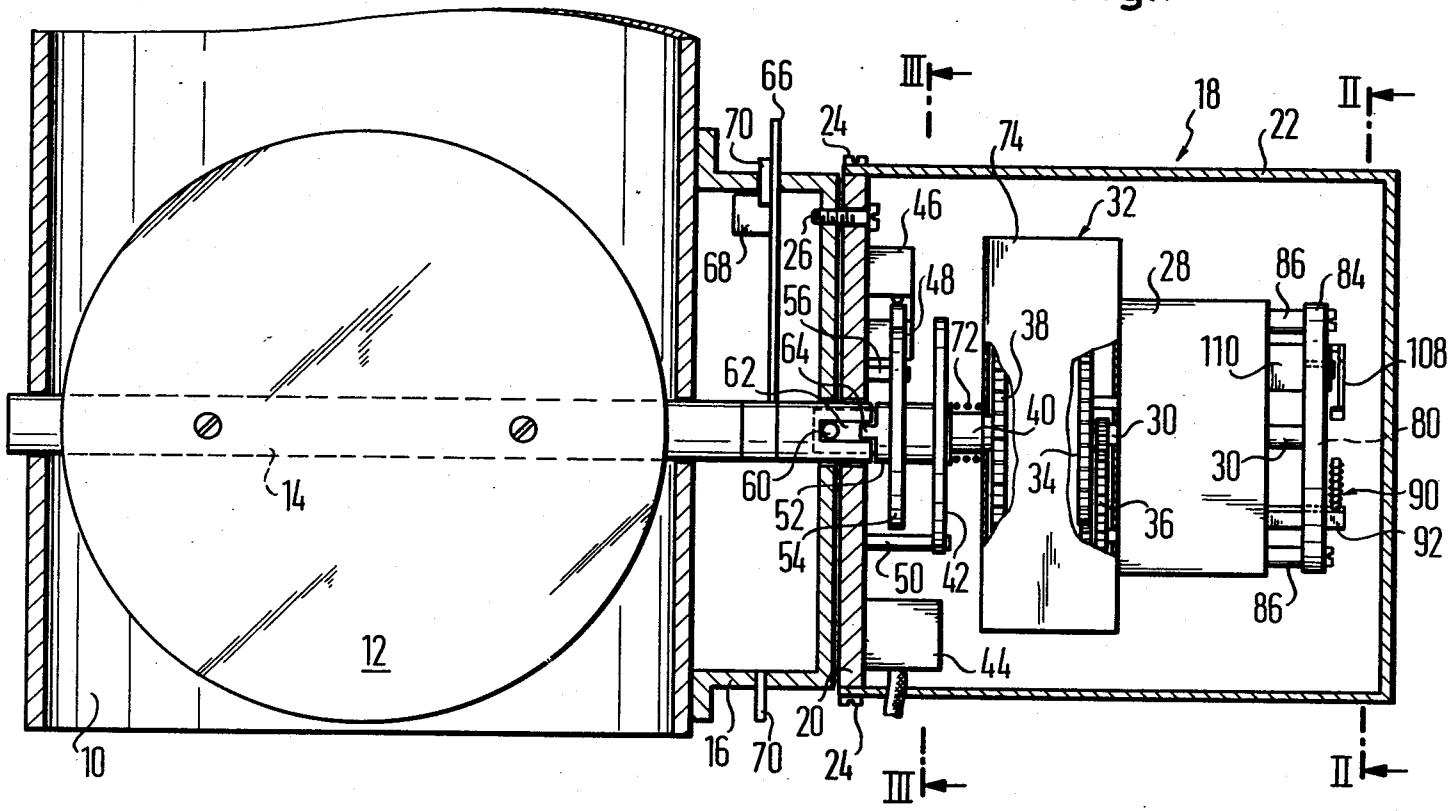
FIG. 1 shows the shut-off device of the invention for a first mode of operation in which opening of the shut-off plate is caused by the positioning motor and closing of the shut-off plate by the spring, the view being in partial section in a plane including the axis of the through-flow housing.

In FIG. 1, there is seen a tubular flow-through housing 10 with a shut-off plate 12 fastened to shut-off plate shaft 14 which passes radially through the flow-through housing. A structural unit 18 is mounted on the flow-through housing 10 and separated from the same by a spacer element 16 fixedly fastened to the through-flow housing 10. The unit comprises a base plate 20 and a casing 22 fixedly and threadedly fasted on the base plate 20 by means of screws 24. The base plate 20 is attached to the spacer element 16 by means of screws 26. A positioning motor for the shut-off plate 12 in the unit is designated 28 and is a rapidly turning electromotor capable of being permanently braked while energized. Motion of the motor shaft 30 is transformed into slower movement by a step-down transmission 32 connected with the motor 28. The step-down transmission 32 is shown in FIG. 1 partly broken open so that a few of the conventionally indicated gears can be seen. On the input side of the transmission facing the motor 28, a pinion 34 secured against rotation on the motor shaft 30 enters into the transmission and meshes with the first spur gear 36 on the input side of the transmission. The rapid rotation of the motor shaft 30 under little power is converted by additional spur gears, only diagrammatically indicated in the transmission 32 into slow rotation with great force of a gear 38 connected at the output side of the transmission with a transmission output shaft 40.

A spiral spring 42, a terminal strip 44, and two limit switches 46, 48 are additionally located within the structural unit. The outer end of the spiral spring 42 is fastened to a retaining pin 50, and the inner end to a sleeve shaped hub 52 freely rotatable and axially movable on the transmission output shaft 40 of the transmission 32.

Figure 3:
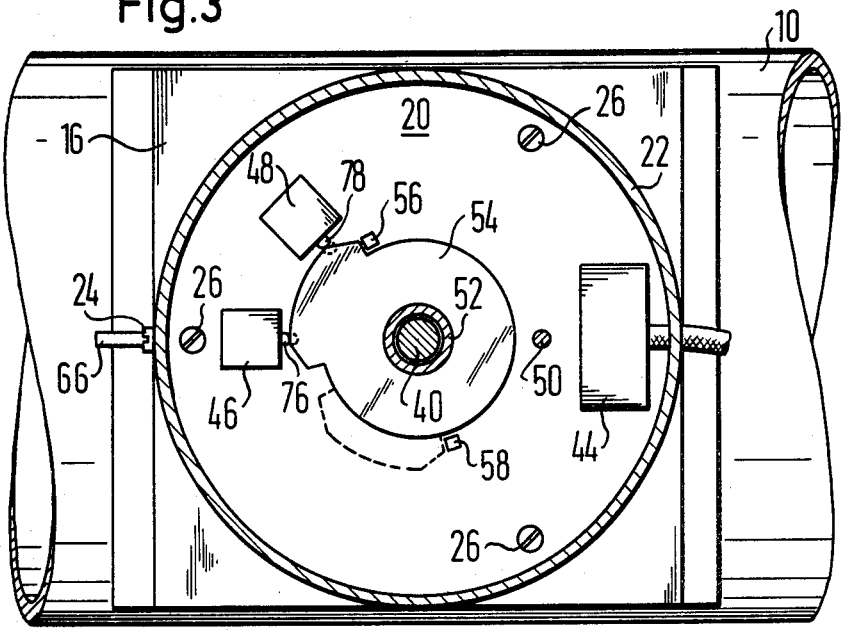
FIG. 3 is a section on the line III—III in FIG. 1.

A control element 54 constituted by a cam disc (FIG. 3) is fixedly fastened to the hub 52. It permits rotation of the hub 52 between two abutments 45, 58 (FIG. 3) and actuates the two limit switches 46, 48 in the terminal position of engagement with the abutment 56. The terminal switches 46, 48 initiate operation of the combustion arrangement, and the functions of the limit switches 46, 48 will still be explained in more detail with reference to the schematics shown in FIGS. 4 to 7. The broken lines in FIG. 3 indicate the position of the control element 54 in the terminal position defined by the abutment 58 in which the limit switches 46, 48 are not engaged by the control element 54.

The end of the shut-off plate shaft 14 passing through the spacer element 16 and directed toward the unit 18 is provided with an axial bore for receiving the free end of the transmission output shaft 40. A pin 60 fastened at the end of the transmission output shaft 40 engages an axial slot 62 at the end of the shut-off plate shaft 14 and thereby connects the transmission output shaft 40 with the shut-off plate shaft 14 for joint movement. In the same manner, the hub 52 is coupled with the shut-off plate shaft 14 by a coupling projection 64 on the side of the hub 52 directed toward the shut-off plate shaft and engaging the slot 62.

A manual operating member 66 is fixedly fastened to the shut-off plate shaft 14 and extends parallel to the shut-off plate 12. It has an arresting vane 68 which may be arrested in the terminal positions of the shut-off plate 12 by arresting latches 70 insertable from the outside.

The shut-off device illustrated in FIG. 1 corresponds to the case in which the shut-off plate 12 is biased toward its closing position by the spiral spring 42 acting on the hub by means of the shut-off plate shaft 14 coupled with the hub 52 and is turned by the positioning motor 28 through the step-down transmission 32 into its open position and secured there. The shut-off plate shaft 14 in turn rotates the hub 52 against the restraint of the spiral spring 42 until the control element 54 can actuate the limit switches 46, 48 which switch the control mechanism of the combustion space on.

The control element 54 on the hub 52 which is freely rotatable relative to the transmission output shaft 40 provides safety for the case in which the connection for joint rotation of the transmission output shaft 40 and the shut-off plate shaft 14 is interrupted for any reason. If the control element 54 were fixedly connected with the transmission output shaft 40, there would be a risk of the shut-off plate 12 remaining in its closing position when the positioning motor 28 is energized, and the combustion space being switched on despite the closed shut-off plate 12. This risk is avoided by the control element 54 being turned away from the limit switches 46, 48 in any event by the spiral spring 42 when the transmission output shaft is uncoupled from the shut-off plate shaft 14.

If the shut-off device of the invention is to be installed at combustion spaces whose electrical installation permits the positioning motor 28 to be kept energized continuously when the combustion space is not being operated, the shut-off device shown in FIG. 1, may be operated, after a minimal modification in such a manner that the shut-off plate 12 is biased by the spiral spring 42 toward the open position and transferred to its closing position by the positioning motor 28. For this purpose, the shut-off plate shaft 14 merely needs to be coupled with the transmission output shaft 40 and the hub 52 in a position turned 90°. At least one additional slot offset 90° from the slot 62 is provided for this purpose on the coupling end of the shut-off plate shaft 14. Additionally in this case, the limit switches 46', 48' are to be arranged, corresponding to the showing of FIG. 8, in such a manner that they are actuated in the terminal position of the control element 54 shown in broken lines in FIG. 3.

With this mode of operation, the control element 54 can be made by the spiral spring to engage the limit switches 46', 48' and the combustion space switched on in the afore-described unfavorable event of an unnoticed uncoupling of the transmission output shaft 40 and shut-off plate shaft 14, even if the shut-off plate 12 is in the closing position. Therefore, a separating spring 72 constituted by a helical compression spring is provided for this mode of operation, envelops the transmission output shaft 40, and engages the transmission casing 74 at one end and the hub 52 at the other end and biases the latter axially toward the free end of the transmission output shaft 40. When the transmission output shaft 40 is pulled out of the axial bore in the coupling end of the shut-off plate shaft 14, the hub 52 is axially shifted until it strikes the pin 60. Thereby the control element 52 also is offset axially of the transmission output shaft 40 that it no longer can engage the switching contacts 76, 78 of the limit switches 46', 48'. The separating spring 72 may be omitted when the shut-off device illustrated in FIG. 1 is used according to the first mode of operation, but does not interfere with this mode of operation, and provides a supplemental safety factor in this case also as in the event of a break in the spiral spring 42.

Figure 2:
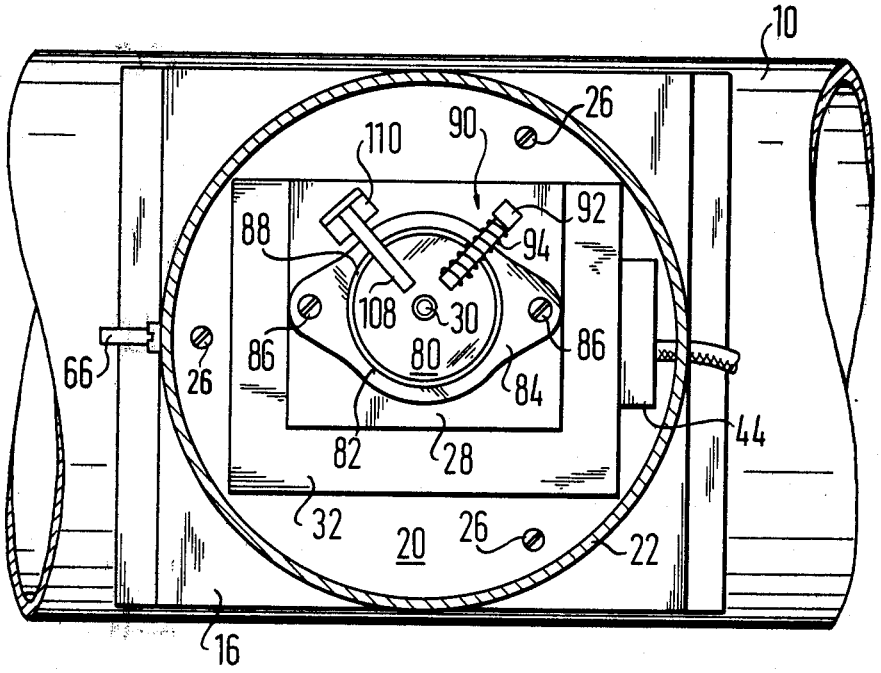
FIG. 2 is a section on the line II—II in FIG. 1.

As is seen in FIGS. 1 and 2, a rotor 80 having the shape of a cylindrical disc is connected for joint rotation with the end of the motor shaft 30 directed away from the shut-off plate 12. The rotor turns in a recess 82 of a stator 84 coaxially to the motor shaft 30. The stator 84 is attached to the side of the positioning motor 28 remote from the transmission by threaded bolts 86. A narrow airgap 88, shown relatively wide in FIGS. 1 and 2 for the sake of clarity only, is defined between the outer circumferential face of the rotor 80 and the inner circumferential face of the recess 82.

When the motor shaft 30 turns, the rotor 80 turns in the recess 82 of the stator 84. The braking moment caused by air turbulence in the air gap 88 and by frictional air drag on the rotor 80 increases with the rotary speed of the motor shaft 30. While the positioning motor 28 runs at a constant rotary speed determined by its structure and the electric parameters, the spiral spring 42 tends to expand suddenly after switching off of the positioning motor 28 and thus drives the motor shaft 30 by way of the hub 52, the shut-off plate shaft 14, the transmission output shaft 40 and the transmission 32 acting in this case as a step-up transmission at a rotary speed which is many times the characteristic rotary speed of the positioning motor 28. At this high rotary speed, the braking moment of the air resistance brake constituted by the rotor 80 and the stator 84 forming an air gap 88 increases so that the return movement of the shut-off plate 12 which is caused by the spiral spring 42 can be braked substantially. Because the air resistance brake acts on the rapidly turning motor shaft 30, a small force acting on the rotor 80 is sufficient for slowing the motor shaft 30 and thereby also the shut-off plate. Therefore, a desired delay in the closing process can be achieved in the case in which the shut-off plate 12 is brought to its open position by the positioning motor 28 and is brought to its closed position by the spiral spring 42.

Figure 4:
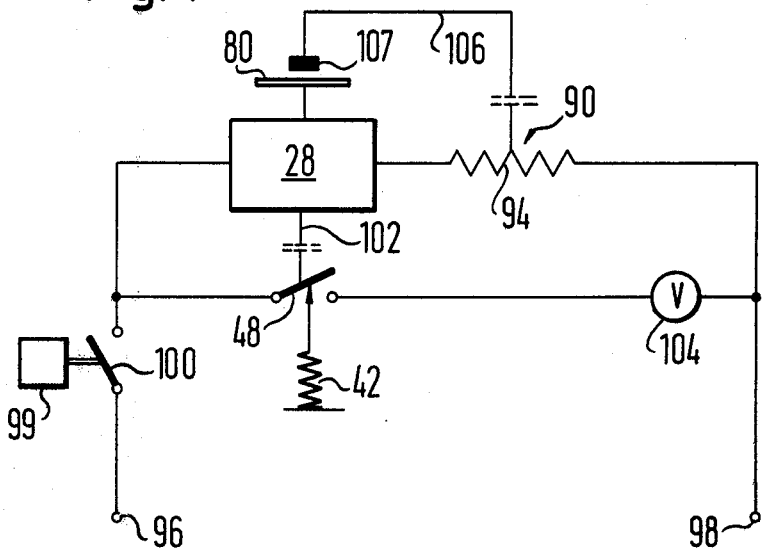
FIGS. 4–6 are schematics of circuits according to a simplified version of the shut-off device of FIG. 1 and show the control of the electric heater of the bi-metal element in the control circuit of the shut-off device.
Figure 5:
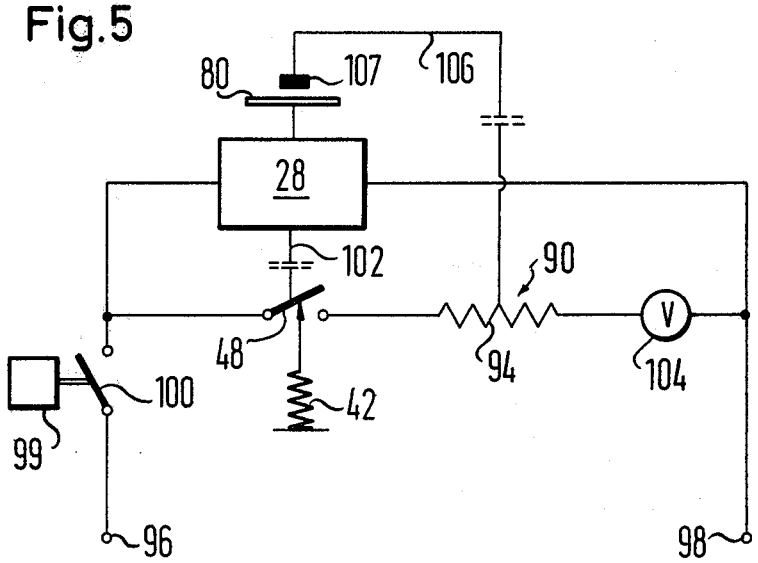
Figure 6:
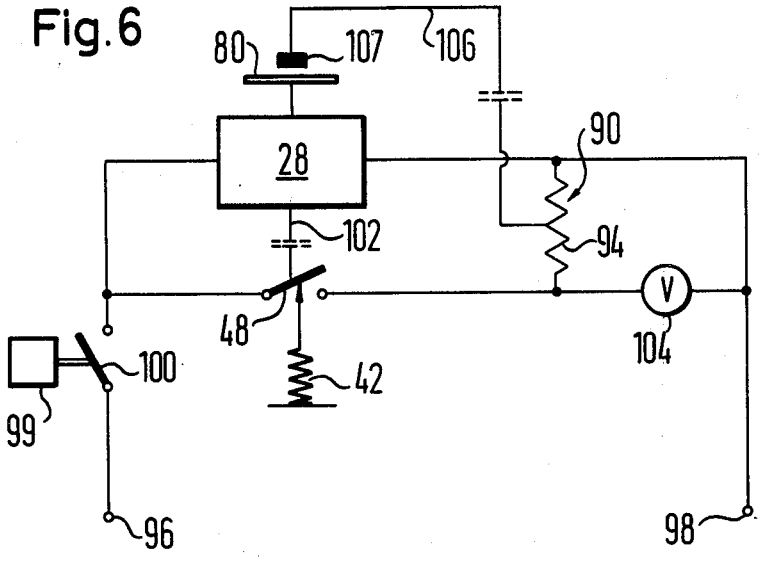

For the reasons explained above, it is desirable under certain circumstances to close the shut-off plate 12 only some time after the switching off of the combustion space. For this purpose, a bimetal element 90 is mounted on the side of the motor 28 remote from the transmission by means of a bracket 92 so as to press against the rotor 80 when it warps. Because a very small force is sufficient, as discussed above, for arresting the rotor 80 and thereby also the shut-off plate 12, the pressure of the bent bimetal element engaging the rotor 80 is sufficient for holding the rotor 80 fast and thereby to prevent a closing of the shut-off plate 12 by the spiral spring 42 until the bimetal element 90 is released from the rotor 80. FIGS. 4 to 6 diagrammatically illustrate different ways of introducing an electrical heater for the bimetal element, constituted by a winding 94 of resistance wire into the control circuit of the shut-off device. The schematics shown in FIGS. 4 to 6 correspond to a simplified modification of the shut-off device illustrated in FIGS. 1 to 3. Only one operating condition of the combustion space is possible in FIGS. 4 to 6, that is, the shut-off plate is pivotable only between a closing position and an open position. In FIGS. 4 to 6, 96 designates one pole and 98 the other pole of a voltage source. The pole 96 is connected with a switch 100 capable of being operated, for example, by a thermostat 99. The switch is connected on one hand with the positioning motor 28 and on the other hand with the limit switch 48. The limit switch 48 can be closed mechanically by the positioning motor 28, as indicated by the arrow 102. A conductor leads from the limit switch 48 to a solenoid valve 104 which starts the nonillustrated combustion space upon closing of the switches 100 and 48.

The three schematics of FIGS. 4 to 6 differ only by the arrangement of the resistance wire winding 94 of the bimetal element 90. In FIG. 4, the resistance winding 94 is connected in series circuit with the positioning motor 28. The mechanical action of the bimetal element 90 on the conventionally indicated rotor 80 is illustrated by a brake linkage 106 with brake shoe 107. When the thermostat 99 closes the switch 100, current flows through the positioning motor 28 and the resistance wire winding 94 of the bimetal element 90. The positioning motor 28 opens the shut-off plate. When the shut-off plate 12 reaches its open position, the limit switch 48 is closed and operation of the combustion space is initiated by the solenoid valve 104. Upon closing of the switch 100, the bimetal element 90 also is heated, but its characteristics are chosen so that it cannot engage the rotor 80 prior to opening of the shut-off plate 12 by the positioning motor 28. Such engagement occurs only after the combustion space has started operating. When the thermostat 99 thereafter opens the switch 100, the positioning motor 28 is deenergized, and the spiral spring 42 now would turn the shut-off plate 12 together with the positioning motor 28 back and thereby open the limit switch 48. However, this is impossible because the bimetal element 90 holds the rotor 80 fast and thereby prevents turning back of the shut-off plate 12 into its closing position. Because the electric heater 94 of the bimetal element 90 no longer receives current, the bimetal element 90 is cooled and lifts off from the rotor 80, so that the latter is released, and the spiral spring 42 can turn the shut-off plate 12 into its closing position, the return moving being braked by the air resistance brake 80, 84, 88.

In the circuit according to FIG. 5, the resistance wire winding 94 is inserted under otherwise identical conditions in the line between the limit switch 48 and the solenoid valve 104. Thus, the bimetal element 90 is heated only after the limit switch 48 is closed and the combustion space 104 is operating. It is entirely irrelevant, therefore, how long the initial delay time is until the bimetal element 90 engages the rotor 80 and holds the same fast. A practical difference from the embodiment of FIG. 4 resides in the fact that the voltage drop at the solenoid valve 104 must be known for selection of the resistance wire winding for the bimetal element 90. Conceivably other connecting operations during connecting of the shut-off device prefabricated as a closed structural unit may result from this.

The afore-mentioned potential difficulty is avoided by an arrangement according to FIG. 6 in which the resistance wire winding 94 is arranged parallel to the solenoid valve 104 so that the entire voltage across the terminals 96, 98 is applied to the resistance wire winding 94 independent of the voltage drop at the solenoid valve.

Figure 9:
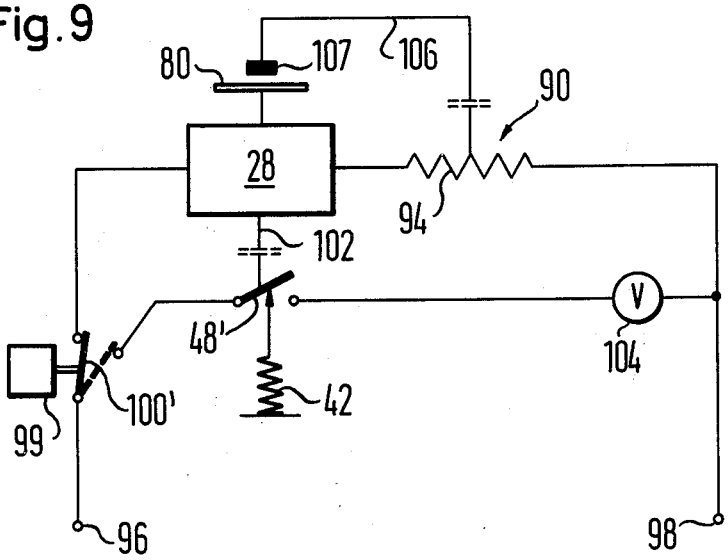
FIG. 9 is a schematic corresponding to that of FIG. 4 for a simplified embodiment of the shut-off device in the second mode of operation.

The circuit illustrated in FIG. 9 is chosen for the afore-described second mode of operation in which the shut-off plate 12 is opened and held open and the limit switch 48' is closed by the spiral spring 42, and the shut-off plate 12 is closed and the limit switch 48' is opened by the positioning motor 28. The switch 100' operable by means of the thermostat 99 has two switching positions. In the one switching position illustrated by a continuous line, the switch 100' connects the terminal 96 with the positioning motor 28 (shut-off plate 12 closed, limit switch 48' open, and brake shoe 107 lifted); in the other switching position indicated by a broken line, the switch 100' connects the terminal 96 directly with the limit switch 48' and simultaneously interrupts the current connection from the terminal 96 to the positioning motor 28 (shut-off plate 12 is opened and limit switch 48' is closed, brake shoe 107 is pressed against the rotor 80. Otherwise, the circuit diagram of FIG. 9 corresponds to that of FIG. 4, that is, the electric heater 94 of the bimetal element 90 is arranged in series circuit with the positioning motor 28. Because the electric heater 94 is switched on only at the switching on of the positioning motor 28, the bimetal element 90 must be arranged in such a manner that it arrest the rotor 80 when cold and lifts from the rotor 80 only with a delay needed for heating, and only then permits closing of the shut-off plate 12.

For the second mode of operation of the shut-off device, the heater 94 of the bimetal element 90 can be arranged in a circuit according to FIGS. 5 and 6 if the same is modified according to FIG. 9.

In the embodiment of the shut-off device on which the schematics of FIGS. 4 to 6 are based, the shut-off plate can assume only two defined positions, namely the closing position in which the shut-off plate 12 is positioned at right angles to the direction of flow in the flow-through housing 10, and the open position in which it is positioned substantially parallel to the direction of flow in the flow-through housing 10. In the embodiment according to FIGS. 1 to 3 and the schematic according to FIG. 7, an additional, defined, intermediate position is provided. Such an intermediate position is desirable in the event that a combustion space has two burners, either one burner alone (partial load operation) or both burners (full load operation) being capable of being operated. In order to hold the shut-off plate 12 in its intermediate position corresponding to partial load operation, a checking element 108 (FIG. 1) is arranged in such a manner that it can be pressed against the rotor 80 by an electromagnet 110 with a force sufficient to halt the rotor 80 and thus also the shut-off plate. The control process is evident from FIG. 7. In this figure, the elements known from FIGS. 4 to 6 are designated again by the same reference numerals.

When a switch 100 is closed, current flows between the terminals 96, 98 by way of the positioning motor 28. This positioning motor 28 turns the shut-off plate 12 in a direction towards its open position until the control element 54 turning with it closes the limit switch 46 and thereby closes a solenoid valve 112 for starting the first burner of the combustion space. When the positioning motor 28 would not be stopped, the shut-off plate 12 would be turned completely into the open position. This would result in too great a cross section of the waste gas line for the first burner so that the first burner cannot be operated under the conditions optimal for the same.

When the switch 46 is closed, current flows through the exciter winding of the electromagnet 110 arranged in parallel circuit with the solenoid valve 112, so that the electromagnet immediately presses the checking element 108 against the rotor 80 and thereby stops the position motor 28. This means, that the positioning motor 28 is stopped without delay upon closing of the limit switch 46, and the shut-off plate 12 remains in its intermediate positions. The combustion space is operated under partial load conditions, an excessively fast withdrawal of the waste gases and the resulting overly great heat loss being avoided by the only partial opening of the waste gas line.

When it is desired to switch from partial load operation to full load operation, a switch 114 is closed, whereby current flows between a terminal 116 and the terminal 98 through a relay 118. This relay 118 opens an interruptor switch 120 in the exciter circuit for the electromagnet 110 so that the electromagnet 110 is deenergized and lifts the checking element 108 from the rotor 80. Because the switch 100 remains closed, the positioning motor 28 rotates at once in a direction toward the open position of the shut-off plate 12 in which the limit switch 48 for operating the solenoid valve 104 is closed, the limit switch 46 remaining closed. Now, both burners of the combustion space are in operation, the combustion space operates at full load.

The resistance wire winding 94 of the bimetal element 90 is arranged in the line between the limit switch 48 and the solenoid valve 104 parallel to the solenoid valve 104. Obviously, the alternative arrangement of the resistance wire winding 94 in series circuit with the solenoid valve 104 corresponding to the circuit of FIG. 5 would be possible. However, the resistance wire winding 94 of the bimetal element 90 must not be arranged in series circuit with the positioning motor 28 nor in the line between the limit switch 46 and the solenoid valve 112 because the bimetal element 90 would hold the positioning motor 28 fast after operation of the first burner is initiated, but would not release the motor upon closing of the switch 114.

The combustion space is switched off by opening both the switch 100 as well as the switch 114. The positioning motor 28, the solenoid valve 104, 112, the resistance wire winding 94, and the electromagnet 110 are deenergized thereby. When the bimetal element 90 has cooled down, it releases the rotor 80, and the shut-off plate 12 is closed by the spiral spring 42, conventionally indicated in the schematics as a compression spring, whereby the limit switches 46, 48 are opened, and the positioning motor 28 is turned back.

Figure 8:
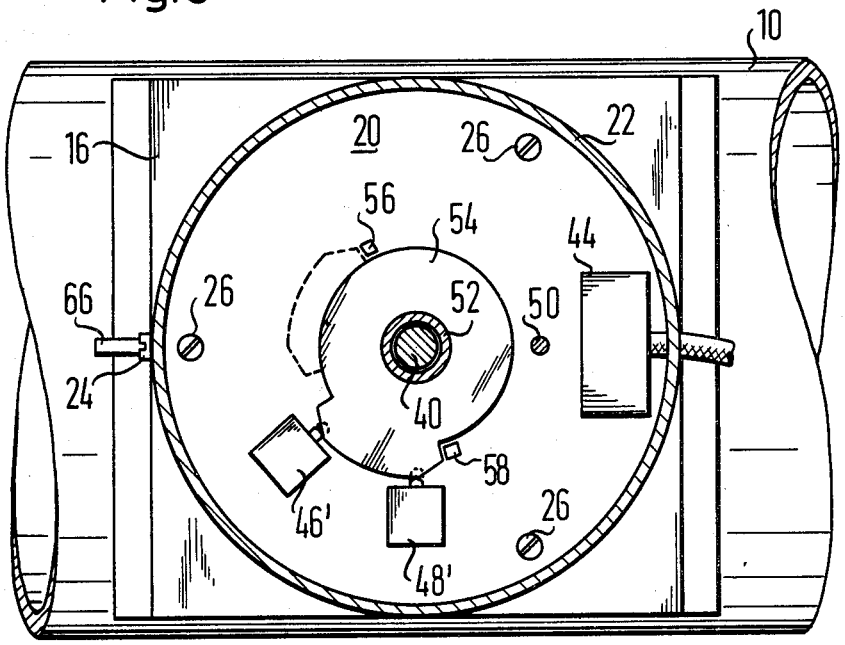
FIG. 8 shows a modification of the shut-off device illustrated in FIG. 1 for a second mode of operation in which opening of the shut-off plate is brought about by the spring, and closing of the shut-off plate by the positioning motor, the view being in a section corresponding to that of FIG. 3.
Figure 7:
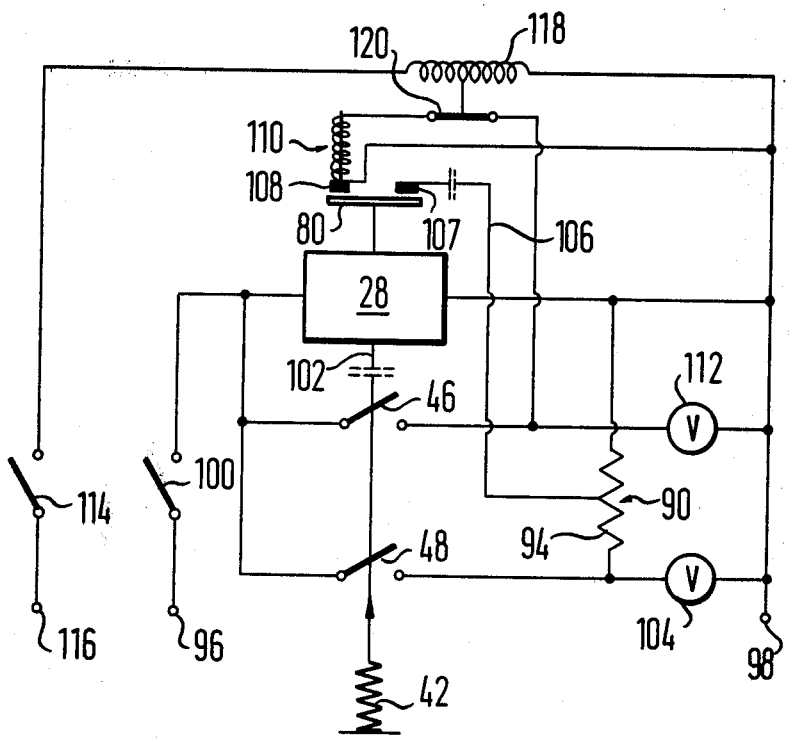
FIG. 7 is a schematic of the control circuit for the embodiment of the invention illustrated in FIG. 1.
Figure 10:
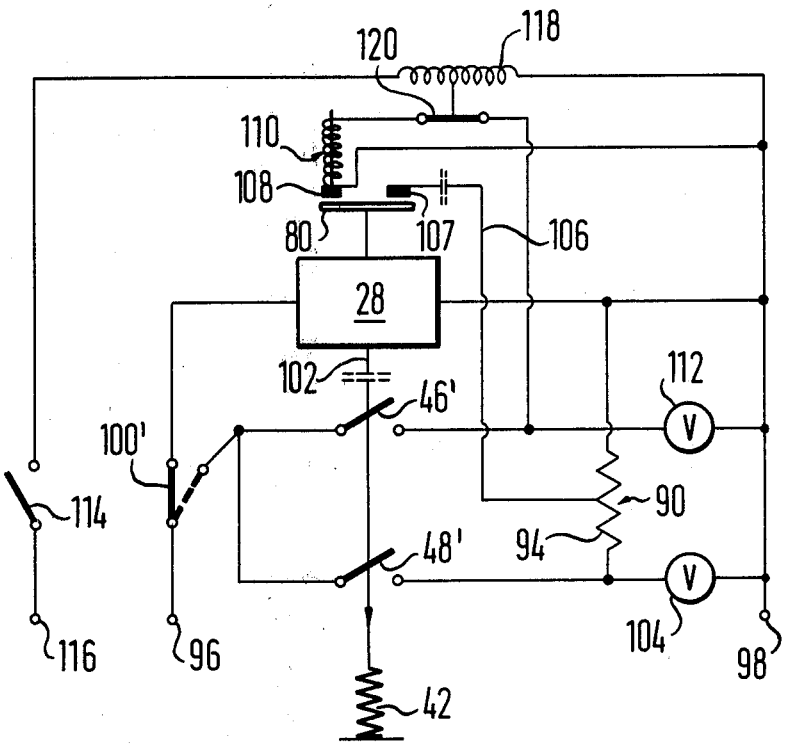
FIG. 10 is a schematic corresponding to FIG. 7 for the embodiment of the shut-off device according to FIG. 8.

A circuit analogous to the circuit of FIG. 7 for the shut-off device of the invention modified in accordance with FIG. 8 is illustrated in FIG. 10. The circuit differs from that in FIG. 7 solely by the provision of a switch 100' which, in the first switching position indicated by a fully drawn line connects the terminal 96 with the positioning motor 28 (shut-off plate 12 closed), and its second switching position indicated by a broken line interrupts the connection between the positioning motor 28 and the terminal 96 and connects the latter with the limit switches 46', 48' (shut-off plate 12 is opened). All other features of the circuit agree with those of the circuit illustrated in FIG. 7.

For starting operation of the combustion space in the partial load range, the switch 100' is moved from its first switching position to the second switching position in which the positioning motor 28 is deenergized and the shut-off plate 12 is opened by the spiral spring 42, the spring being conventionally shown in FIG. 10 as a tension spring. The checking element 108 is actuated, the full-load operation of the combustion space is initiated, and the electrical heater of the bimetal element 90 is switched as in the embodiment described with reference to FIG. 7.

For shutting down the combustion space, the switch 114 is opened, and the switch 100' is moved to its first switching position in which it connects the terminal 96 with the positioning motor 28. Current then flows through the positioning motor 28 while the limit switches 46', 48', the solenoid valves 104, 112 and the electromagnet 110, the relay 118, and the electric heater 94 of the bimetal element 90 are deenergized. After delayed release of the rotor 80 by the bimetal element 90, the shut-off plate 12 is turned back into its closing position by the positioning motor 28, the limit switches 46', 48' being opened.

In the above exemplary embodiments, both the bimetal element 90 as well as the checking element 108 engage the rotor 80. This is a particularly simple and elegant solution in which significant improvements over the shut-off devices known heretofore are achieved by a minor modification of a commercially available positioning motor and with a minimum expense for circuitry. Obviously, it is also possible to arrange the bimetal element 90 and the checking element 108 in such a manner that they engage transmission parts near the transmission input side as for example the gear 36, and thereby stop the positioning motor 28.

We claim:

1. Shut-off device for installation in the waste gas line from a combustion device comprising:

(a) a flow-through housing;

(b) a shut-off plate mounted in this flow-through housing and movable between an open position and a closed position;

(c) a drive unit for said shut-off plate, said drive unit being located externally of said flow-through housing, said shut-off plate being biased by spring means toward a first terminal position defined by a first abutment and being adjustable by said drive unit against the biasing action of said spring means toward a second abutment;

(d) at least one switch stationary with respect to said flow-through housing, said switch being incorporated in an electric control circuit of said combustion device;

(e) a switch control element mounted for joint movement with said shut-off plate and acting on said switch for controlling operation of said combustion device;

(f) said drive unit including an electric motor having a rotatable motor shaft connected with an input shaft of a step down gear means for slowing down the rotary speed of said motor shaft, an output shaft of said step down gear means being connected with said shut-off plate, said gear means establishing a closed torque transmission from said motor shaft to said shut-off plate independently of electric control means;

(g) said spring means engaging an engaging member rotatable by said drive unit with a rotary speed substantially equal to the rotary speed of said output shaft; and (h) a rotation control device being provided for engagement with a control device engaging member rotatable by said drive unit with a rotary speed substantially equal to the rotary speed of said motor shfat.

2. Shut-off device according to claim 1, wherein said rotation control device includes a brake member exerting a braking moment on said control device engaging member, said braking moment increasing with increasing rotary speed.

3. Shut-off device according to claim 1, wherein said rotation control device includes a brake member exerting a different braking moment on said control device engaging member responsive to the direction of rotation of said motor shaft.

4. Shut-off device according to claim 1, wherein the control device engaging member is constituted by a substantially cylindrical rotor rotatable in a substantially cylindrical, coaxial recess of a stator defining said rotation control device, an air gap being formed between the circumferential surface of the rotor and the circumferential surface of the recess.

5. Shut-off device according to claim 2, wherein the control device engaging member is arranged on the axial end of said electric motor remote from said gear means.

6. Shut-off device according to claim 1, wherein said rotation control device is controlled in such a manner that it does not impede opening of said shut-off plate when operation of the combustion device is initiated, but delays closing of the shut-off plate after operation of the combustion device is stopped.

7. Shut-off device according to claim 1, wherein said rotation control device includes an electrically heatable bimetal element.

8. Shut-off device according to claim 7, wherein the electric heater of the bimetal element responds to the condition of operation of the electric motor.

9. Shut-off device according to claim 7, with the shut-off plate being closed by the electric motor and being opened and held open by the spring means wherein the rotation control device is activated for engagement with said control device engaging member in response to switching on of the combustion device, and is inactivated in response to switching off of the combustion device, delay means being provided for delaying the inactivation of the rotation control device in response to the switching off of the combustion device.

10. Shut-off device according to claim 8, wherein the heater of the bimetal element is arranged in a series circuit with the switch.

11. Shut-off device according to claim 10, wherein the electric heater is arranged in parallel circuit with a solenoid valve serving for initiating operation of the combustion device.

12. Shut-off device according to claim 10, wherein the heater is arranged in a series circuit with a solenoid valve serving for initiating operation of the combustion device.

13. Shut-off device according to claim 1, wherein with a combustion device capable of being operated in two different ranges of output capacity, the rotation control device is controlled in such a manner that it becomes effective in an intermediate position of the shut-off plate corresponding to operation under partial load, and that it becomes ineffective during a change in the condition of operation of the combustion device.

14. Shut-off device according to claim 13, wherein there is provided an additional switch, capable of being actuated in the intermediate position of the shut-off plate by the switch control element, and serving for initiating operation of the combustion device in the partial load operation, the rotation control device becoming effective by actuation of the additional switch, and wherein the rotation control device is capable of being released independently of a change in the switching condition of the additional switch.

15. Shut-off device according to claim 14, wherein the rotation control device includes an electrically operable checking member.

16. Shut-off device according to claim 15, wherein the checking member is capable of being actuated by an electromagnet arranged in a series circuit through an interruptor switch with the additional switch, an opening of the interruptor switch inactivating the checking member.

17. Shut-off device according to claim 1, with the shut-off plate being closed by the spring means and being opened and held open by the electric motor, wherein the rotation control device is activated for engagement with the control device engaging member in response to switching on of the motor current of the electric motor, delay means being provided for activating the rotation control device only with a delay after the opening of the shut-off plate, and wherein the rotation control device is inactivated in response to switching off the motor current, said delay means being provided for inactivating the rotation control device only with a delay after switching off the motor current of the electric motor.

18. Shut-off device according to claim 1, with the shut-off plate being closed by the spring means and being opened and held open by the electric motor, wheren the rotation control device is activated for engagement with said control device engaging member in response to switching on of the combustion device, and is inactivated in response to switching off of the combustion device, delay means being provided for delaying the inactivation of the rotation control device in response to the switching off of the combustion device.

19. Shut-off device according to claim 1, with the shut-off plate being opened and held open by the spring means and being closed by the electric motor, wherein the rotation control device is inactivated for disengagement with the control device engaging member in response to the switching on of the motor current, delay means being provided for delaying the inactivation of the rotation control device after the switching on of the motor current, and wherein the rotation control device is activated for engagement with the control device engagement member in response to the switching off of the motor current, said delay means being provided for delaying the activation of the rotation control device until the shut-off plate has been opened.

* * * * *